US011655616B2

(12) United States Patent
Wutke

(10) Patent No.: US 11,655,616 B2
(45) Date of Patent: May 23, 2023

(54) INDUSTRIAL MACHINE INCLUDING AUTOMATED DUMP CONTROL

(71) Applicant: Joy Global Surface Mining Inc, Milwaukee, WI (US)

(72) Inventor: Joseph Robert Wutke, Muskego, WI (US)

(73) Assignee: JOY GLOBAL SURFACE MINING INC., Milwaukee, WI (US)

( * ) Notice: Subject to any disclaimer, the term of this patent is extended or adjusted under 35 U.S.C. 154(b) by 256 days.

(21) Appl. No.: 16/897,402

(22) Filed: Jun. 10, 2020

(65) Prior Publication Data

US 2020/0399866 A1 Dec. 24, 2020

Related U.S. Application Data

(60) Provisional application No. 62/863,993, filed on Jun. 20, 2019.

(51) Int. Cl.
*E02F 9/26* (2006.01)
*E02F 9/22* (2006.01)
(Continued)

(52) U.S. Cl.
CPC ..... *E02F 9/264* (2013.01); *E02F 3/52* (2013.01); *E02F 3/60* (2013.01); *E02F 9/2278* (2013.01); *E02F 9/24* (2013.01)

(58) Field of Classification Search
CPC ..... E02F 9/264; E02F 3/52; E02F 3/60; E02F 9/2278; E02F 9/24
(Continued)

(56) References Cited

U.S. PATENT DOCUMENTS 4,844,685 A * 7/1989 Sagaser ..... E02F 3/433 91/363 R
4,950,125 A 8/1990 Gravenhorst
(Continued)

FOREIGN PATENT DOCUMENTS

CN 106906866 A 6/2017
CN 213268038 U 5/2021
(Continued)

OTHER PUBLICATIONS

Chilean Patent Office Action and Search Report for Application No. 202001594 dated Mar. 10, 2021 (22 pages including statement of relevance).
(Continued)

*Primary Examiner* — Rebecca A Volentine
*Assistant Examiner* — Matthew David Kim
(74) *Attorney, Agent, or Firm* — Michael Best & Friedrich LLP

(57) ABSTRACT

Embodiments described herein provide for the control of an industrial machine dump operation by monitoring a position of the piston within a dump cylinder. The position of the piston is determined using a sensor within the dump cylinder. The sensor generates and provides an output signal to a controller. Based the output signal from the sensor, the controller is configured to limit the travel of the dump cylinder during the dump operation to reduce wear on the dump cylinder (e.g., by preventing damage caused when the dump cylinder is extending or retracting rapidly and the internal cylinder components make forceful contact with the rod or cap end).

20 Claims, 12 Drawing Sheets

(51) Int. Cl.
*E02F 3/60* (2006.01)
*E02F 3/52* (2006.01)
*E02F 9/24* (2006.01)

(58) Field of Classification Search
USPC ..... 701/50
See application file for complete search history.

(56) References Cited

U.S. PATENT DOCUMENTS

| | | | | |
|---|---|---|---|---|
| 5,446,980 | A | 9/1995 | Rocke | |
| 5,701,793 | A | 12/1997 | Gardner et al. | |
| 5,905,215 | A | 5/1999 | Jin et al. | |
| 5,918,199 | A | 6/1999 | Yang et al. | |
| 5,977,778 | A | 11/1999 | Chan et al. | |
| 6,509,733 | B2 | 1/2003 | Blubaugh et al. | |
| 6,722,261 | B1 | 4/2004 | Brown et al. | |
| 7,934,329 | B2 | 5/2011 | Mintah et al. | |
| 8,527,158 | B2 | 9/2013 | Faivre et al. | |
| 8,800,208 | B2 * | 8/2014 | Keller | E05F 15/50 49/506 |
| 9,115,483 | B2 | 8/2015 | Sakuda et al. | |
| 9,163,387 | B2 | 10/2015 | Yuan et al. | |
| 9,447,563 | B2 | 9/2016 | Ikegami et al. | |
| 9,551,133 | B2 | 1/2017 | Ikegami et al. | |
| 10,106,951 | B2 | 10/2018 | Myers | |
| 10,138,915 | B2 | 11/2018 | Bhaskar et al. | |
| 10,323,381 | B2 | 6/2019 | Fujii et al. | |
| 2008/0263909 | A1 * | 10/2008 | Schoenmaker | E02F 9/264 711/100 |
| 2009/0301075 | A1 * | 12/2009 | Morinaga | E02F 9/2037 60/459 |
| 2014/0079519 | A1 | 3/2014 | Hobenshield | |
| 2015/0096440 | A1 | 4/2015 | Subrt | |
| 2016/0201408 | A1 * | 7/2016 | Little | E21B 19/14 414/730 |
| 2018/0058041 | A1 | 3/2018 | Kamoshita et al. | |
| 2021/0230827 | A1 * | 7/2021 | Bitter | E02F 3/4075 |

FOREIGN PATENT DOCUMENTS

| | | | |
|---|---|---|---|
| EP | 1752664 | A2 | 2/2007 |
| EP | 3385456 | A1 | 10/2018 |
| JP | 2002021804 | A | 1/2002 |

OTHER PUBLICATIONS

Komatsu, "PC210LCi-10 Tier 4 Interim Engine," © 2014 (24 pages).
Chinese Patent Office Action for Related Application No. 202010523366.2 dated Dec. 2, 2022 (14 pages, including a brief English summary).

* cited by examiner

INDUSTRIAL MACHINE INCLUDING AUTOMATED DUMP CONTROL

FIELD

Embodiments described herein relate to an industrial machine, such as a shovel or excavator.

SUMMARY

Conventionally, a dump process (e.g., bucket open) for a hydraulic excavator is initiated and controlled by an operator of the excavator using, for example, an analog sensor associated with a foot pedal. However, without knowing the position of a dump cylinder (i.e., a position of the piston within the dump cylinder), the piston can travel to a fully extended and/or retracted position at a very high speed. Reaching the fully extended or retracted position at a high speed can result in component wear and premature component failure.

Embodiments described herein provide for the control of an industrial machine dump operation by monitoring a position of the piston within a dump cylinder. The position of the piston is determined using a sensor that can be included within the dump cylinder. The sensor generates and provides an output signal to a controller. Based on the output signal from the sensor, the controller is configured to limit the travel and speed of the dump cylinder during the dump operation to reduce wear on the dump cylinder (e.g., by preventing damage caused when the dump cylinder is extending or retracting rapidly and the internal cylinder components make forceful contact with the rod or cap end). In some embodiments, the dump operation is automated to automatically open and close the bucket door within the bucket's full range of motion. For example, the position sensor can be calibrated and used to implement a reduced speed region where the dump cylinder piston is slowed down to gradually approach an end-of-travel position. As a result, shock forces experienced by the internal components of the dump cylinder are reduced and the operational life of the dump cylinders can be improved.

In some embodiments, an industrial machine is provided including a bucket, a dump cylinder, a position sensor, and an electronic controller. The bucket has a main body and a door, and the industrial machine is configured to maneuver the bucket to dig material. The dump cylinder has a piston and is configured to open and close the door. The position sensor is configured to sense a position of the piston within the dump cylinder. The electronic controller includes a processor and a memory, and is configured to control the dump cylinder at an initial speed from a first position towards a second position to move the door. The electronic controller is further configured to receive an output signal from the position sensor, and determines the position of the piston based on the output signal. The electronic controller is further configured to reduce a speed of the dump cylinder, as the dump cylinder moves from the first position towards the second position, from the initial speed based on the determined position of the piston.

In some embodiments, the electronic controller is further configured to determine, based on a further output signal from the position sensor, when the piston reaches the second position, and to stop the dump cylinder based on determining that the piston reaches the second position.

In some embodiments, the first position is selected from a group of a full-open target position in which the door is open and materials within the bucket are dumped and a full-close target position in which the door is closed and materials within the bucket are retained, and the second position is the other of the full-open target position and the full-close target position.

In some embodiments, to reduce the speed of the dump cylinder from the initial speed based on the output signal, the electronic controller is configured to reduce the speed of the dump cylinder according to a function selected from a group of a linear ramp-down function, a logarithmic ramp-down function, and quadratic ramp-down function.

In some embodiments, the second position is an end of travel position, and the piston further includes a speed transition point located between the first position and the second position, the speed transition point being nearer to the second position than the first position. In some of these embodiments, to reduce the speed of the dump cylinder from the initial speed based on the output signal, the electronic controller is configured to determine, based on the output signal, that the piston has reached the speed transition point, and, in response, reduce the speed of the dump cylinder from the initial speed.

In some embodiments, the electronic controller is further configured to calibrate the position sensor to thereby learn the first position, the second position, and the speed transition point of the dump cylinder.

In some embodiments, the electronic controller is further configured to: control the dump cylinder at an initial return speed from the second position towards the first position to move the door; receive a further output signal from the position sensor; determine the position of the piston based on the further output signal; and, as the dump cylinder moves from the second position towards the first position, reduce the speed of the dump cylinder from the initial return speed based on the position of the piston determined based on the further output signal.

In some embodiments, at least one selected from a group of the initial speed and the initial return speed is a maximum speed of the dump cylinder.

In some embodiments, the electronic controller is further configured to receive a signal to activate an automatic dump control from a user interface. In some of these embodiments, the electronic controller is configured to control the dump cylinder at the initial speed to move from the first position towards the second position in response to receiving the signal to activate the automatic dump control.

In another embodiment, a method is provided for controlling a bucket of an industrial machine. The industrial machine is configured to maneuver the bucket to dig material, and the bucket has a main body and a door. The method includes controlling, by an electronic controller, a dump cylinder at an initial speed from a first position towards a second position to move the door of the bucket. The dump cylinder has a piston and is configured to open and close the door. The electronic controller further receives an output signal from a position sensor that is configured to sense a position of the piston within the dump cylinder, and determines the position of the piston based on the output signal. As the dump cylinder moves from the first position towards the second position, the electronic controller reduces a speed of the dump cylinder from the initial speed based on the determined position of the piston.

In some embodiments of the method, the electronic controller determines when the piston reaches the second position based on a further output signal from the position sensor; and stops the dump cylinder based on determining that the piston reaches the second position.

In some embodiments of the method, the first position is selected from a group of a full-open target position in which the door is open and materials within the bucket are dumped and a full-close target position in which the door is closed and materials within the bucket are retained, and the second position is the other of the full-open target position and the full-close target position.

In some embodiments of the method, to reduce the speed of the dump cylinder from the initial speed based on the output signal, the electronic controller reduces the speed of the dump cylinder according to a function selected from a group of a linear ramp-down function, a logarithmic ramp-down function, and quadratic ramp-down function.

In some embodiments of the method, the second position is an end of travel position, and the piston further includes a speed transition point located between the first position and the second position, the speed transition point being nearer to the second position than the first position. In some of these embodiments, to reduce the speed of the dump cylinder from the initial speed based on the output signal, the electronic controller determines, based on the output signal, that the piston has reached the speed transition point, and, in response, reduces the speed of the dump cylinder from the initial speed.

In some embodiments, the method further includes calibrating the position sensor to thereby learn the first position, the second position, and the speed transition point of the dump cylinder.

In some embodiments of the method, the electronic controller controls the dump cylinder at an initial return speed from the second position towards the first position to move the door; receives a further output signal from the position sensor; determines the position of the piston based on the further output signal; and, as the dump cylinder moves from the second position towards the first position, reduces the speed of the dump cylinder from the initial return speed based on the position of the piston determined based on the further output signal.

In some embodiments of the method, at least one selected from a group of the initial speed and the initial return speed is a maximum speed of the dump cylinder.

In some embodiments of the method, the electronic controller receives a signal to activate an automatic dump control from a user interface and controls the dump cylinder at the initial speed to move from the first position towards the second position is in response to receiving the signal to activate the automatic dump control.

Other aspects of the embodiments will become apparent by consideration of the detailed description and accompanying drawings.

DETAILED DESCRIPTION

Figure 1:
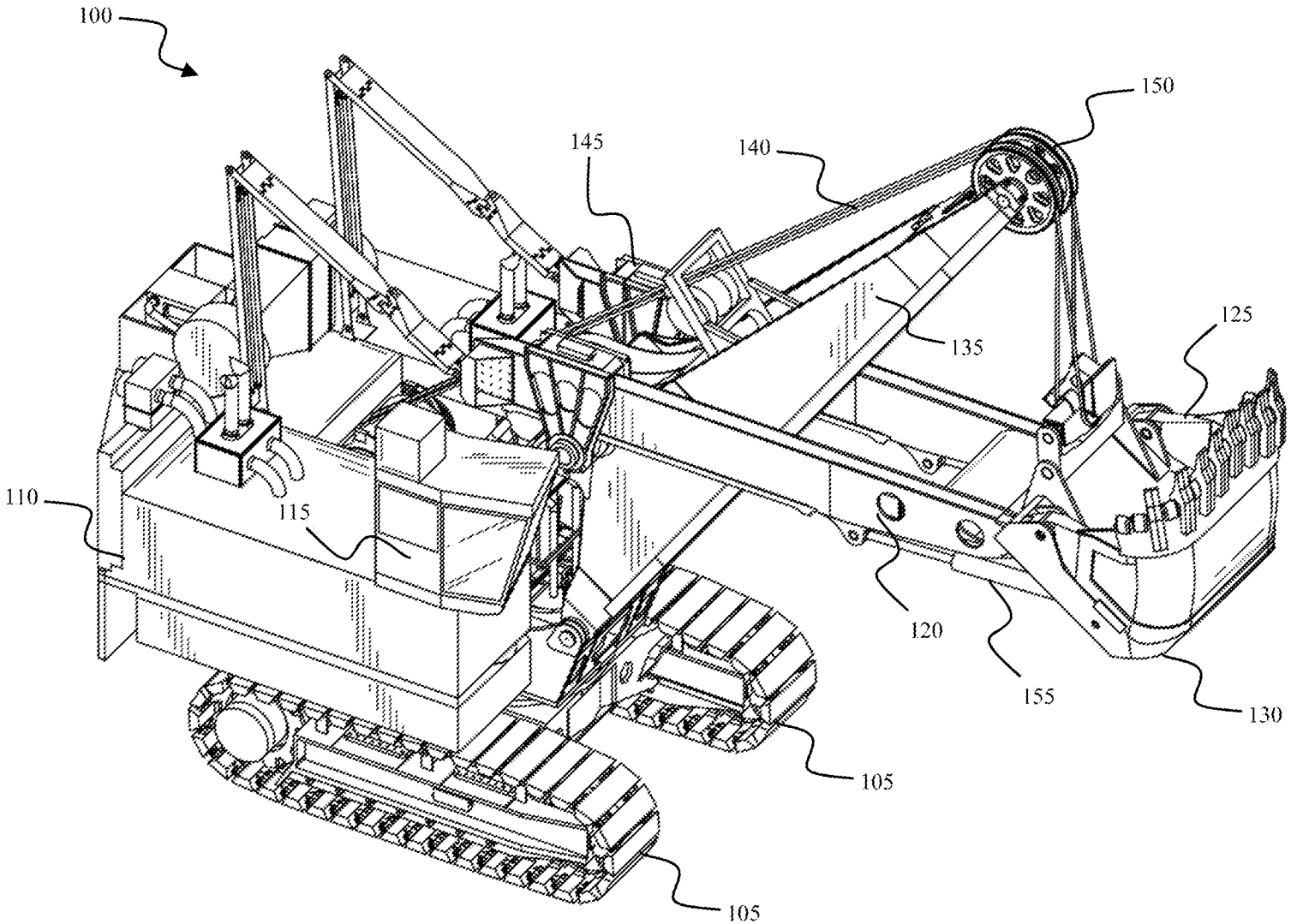
FIG. 1 illustrates an industrial machine, according to embodiments described herein.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers," "computing devices," "controllers," "processors," etc., described in the specification can include one or more processing units, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4". The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

Although embodiments described herein can be applied to, performed by, or used in conjunction with a variety of industrial machines (e.g., a rope shovel, AC machines, DC machines, hydraulic excavators, etc.), embodiments described herein are described with respect to an electric rope or power shovel, such as the shovel 100 shown in FIG. 1. The shovel 100 includes tracks 105 for propelling the shovel 100 forward and backward, and for turning the shovel 100 (i.e., by varying the speed and/or direction of left and right tracks relative to each other). The tracks 105 support a base 110 including a cab 115. The shovel 100 further includes a pivotable bucket handle 120 and an attachment 125. In this embodiment, the attachment 125 is illustrated as a bucket. The attachment 125 includes a door 130 for dumping contents of the attachment 125. The base 110 is able to swing or swivel relative to the tracks 105 to move the attachment 125 from a digging location to a dumping location. The shovel 100 includes a boom 135 and hoist cable(s) 140 that may be wound and unwound within the base 110 to raise and lower the attachment 125. The shovel 100 also includes a saddle block 145 and a sheave 150. The tilt or angle of the attachment 125 is controlled using tilt hydraulic cylinders 155. As described in greater detail below, the door 130 is controlled by dump hydraulic cylinders.

The shovel 100 uses four main types of movement: forward and reverse, hoist, crowd, and swing. Through this movement, the shovel 100 is configured to maneuver the bucket 125 to dig materials. Forward and reverse moves the entire shovel 100 forward and backward using the tracks 105. Hoist moves the attachment 125 up and down. Crowd extends and retracts the attachment 125. Swing pivots the shovel 100 about an axis of the base 110. Overall movement of the shovel 100 utilizes one or a combination of forward and reverse, hoist, crowd, and swing.

Figure 2:
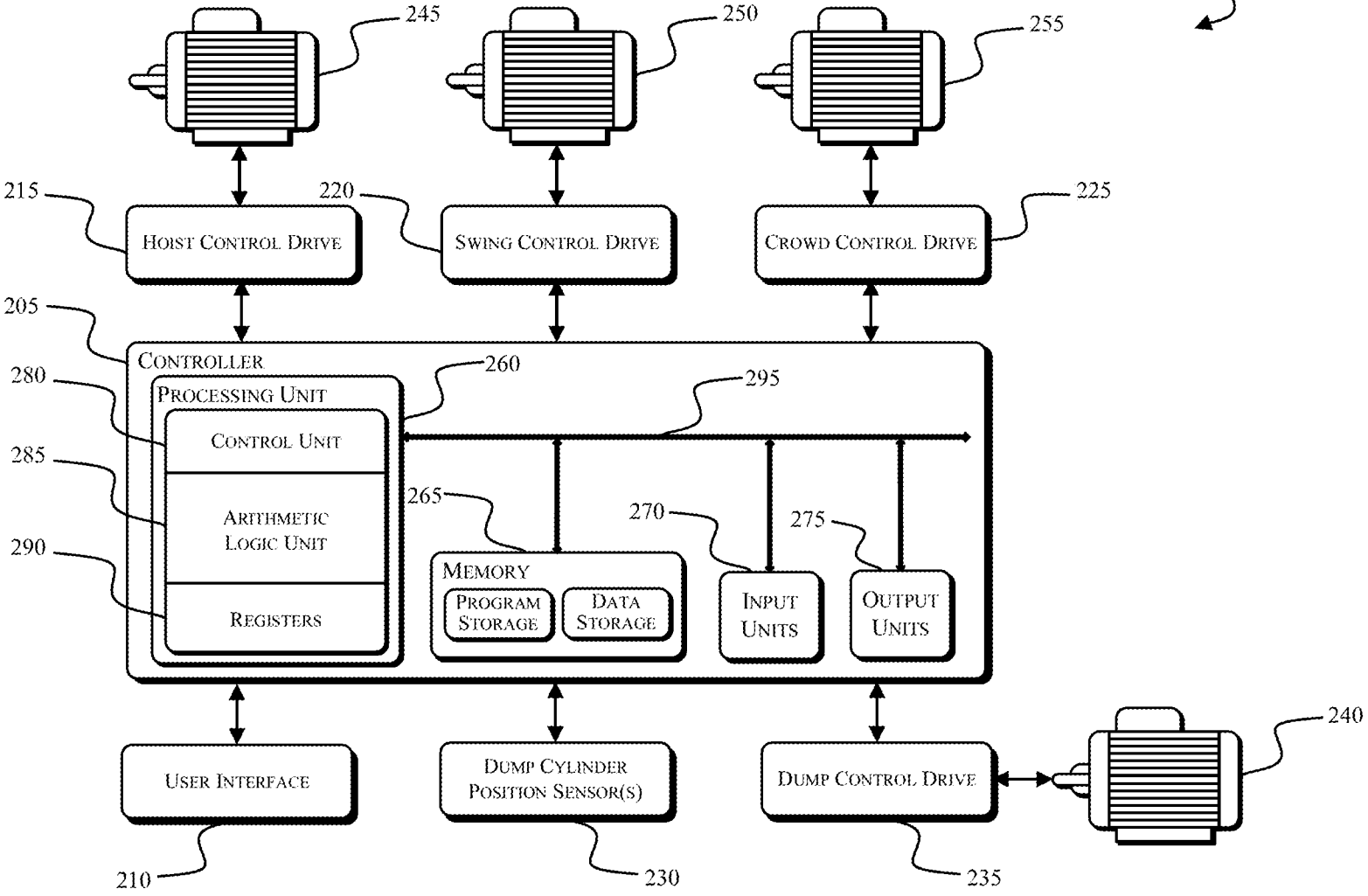
FIG. 2 illustrates a control system for an industrial machine, according to embodiments described herein.

The shovel 100 includes a control system 200 including a controller 205, as shown in FIG. 2. The controller 205, also referred to as an electronic controller, is electrically and/or communicatively connected to a variety of modules or components of the system 200 or shovel 100. For example, the illustrated controller 205 is connected to a user interface module 210, a hoist control drive 215, a swing control drive 220, a crowd control drive 225, one or more dump cylinder position sensors 230, and a dump control drive 235. The dump control drive 235 is connected to a dump actuator 240 (e.g., a hydraulic motor/pump), the hoist control drive 215 is connected to a hoist actuator 245 (e.g., a hoist motor), the swing control drive 220 is connected to a swing actuator 250 (e.g., a swing motor), and the crowd control drive 225 is connected to a crowd actuator 255 (e.g., a crowd motor). The controller 205 includes combinations of hardware and software that are operable to, among other things, control the operation of the system 200, control the operation of the shovel 100, receive input from a user via the user interface 210, provide information to a user via the user interface 210, etc.

The controller 205 includes a plurality of electrical and electronic components that provide power, operational control, and protection to the components and modules within the controller 205, system 200, and/or shovel 100. For example, the controller 205 includes, among other things, a processing unit 260 (e.g., a microprocessor, a microcontroller, or another suitable programmable device), a memory 265, input units 270, and output units 275. The processing unit 260 includes, among other things, a control unit 280, an arithmetic logic unit ("ALU") 285, and a plurality of registers 290 (shown as a group of registers in FIG. 2), and is implemented using a known computer architecture (e.g., a modified Harvard architecture, a von Neumann architecture, etc.). The processing unit 260, the memory 265, the input units 270, and the output units 275, as well as the various modules or circuits connected to the controller 205 are connected by one or more control and/or data buses (e.g., common bus 295). The control and/or data buses are shown generally in FIG. 2 for illustrative purposes. The use of one or more control and/or data buses for the interconnection between and communication among the various modules, circuits, and components would be known to a person skilled in the art in view of the embodiments described herein.

The memory 265 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 260 is connected to the memory 265 and executes software instructions that are capable of being stored in a RAM of the memory 265 (e.g., during execution), a ROM of the memory 265 (e.g., on a generally permanent basis), or another non-transitory computer readable medium such as another memory or a disc. Software included in the implementation of the system 200 and controller 205 can be stored in the memory 265 of the controller 205. The software includes, for example, firmware, one or more applications, program data, filters, rules, one or more program modules, and other executable instructions. The controller 205 is configured to retrieve from the memory 265 and execute, among other things, instructions related to the control processes and methods described herein. In other embodiments, the controller 205 includes additional, fewer, or different components. For example, although the controller 205 is illustrated as a single unit, in some embodiments, the controller 205 is made up of more than one controller and logic and processing may be distributed among the multiple controllers. Regardless of how they are combined or divided, hardware and software components may be located on the same computing device or may be distributed among different computing devices connected by one or more networks or other suitable communication links.

The user interface module 210 is used to control and/or monitor the shovel 100. For example, the user interface module 210 is operably coupled to the controller 205 to control the position of the bucket 125, the position of the boom 135, the position of the bucket handle 120, etc. The controller 205 is configured to receive input signals from the user interface module 210. The user interface module 210 includes a combination of digital and analog input or output devices required to achieve a desired level of control and monitoring for the shovel 100. For example, the user interface module 210 includes a display (e.g., a primary display, a secondary display, etc.) and input devices such as touch-screen displays, joysticks, a plurality of knobs, dials, switches, buttons, pedals, etc. The user interface module 210 can also be configured to display conditions or data associated with the shovel 100 in real-time or substantially real-time. For example, the user interface module 210 is configured to display measured electrical characteristics of the shovel 100, the status of the shovel 100, the position of the bucket 125, the position of the bucket handle 120, etc. The controller 205 also receives motion command signals from the user interface module 210. The motion command signals include, for example, hoist up, hoist down, crowd extend, crowd retract, swing clockwise, swing counterclockwise, bucket door open, left track forward, left track reverse, right track forward, and right track reverse. Upon receiving a motion command signal, the controller 205 controls the hoist control drive 215, the swing control drive 220, the crowd control drive 225, and the dump control drive 235, as commanded by the operator.

Figure 3:
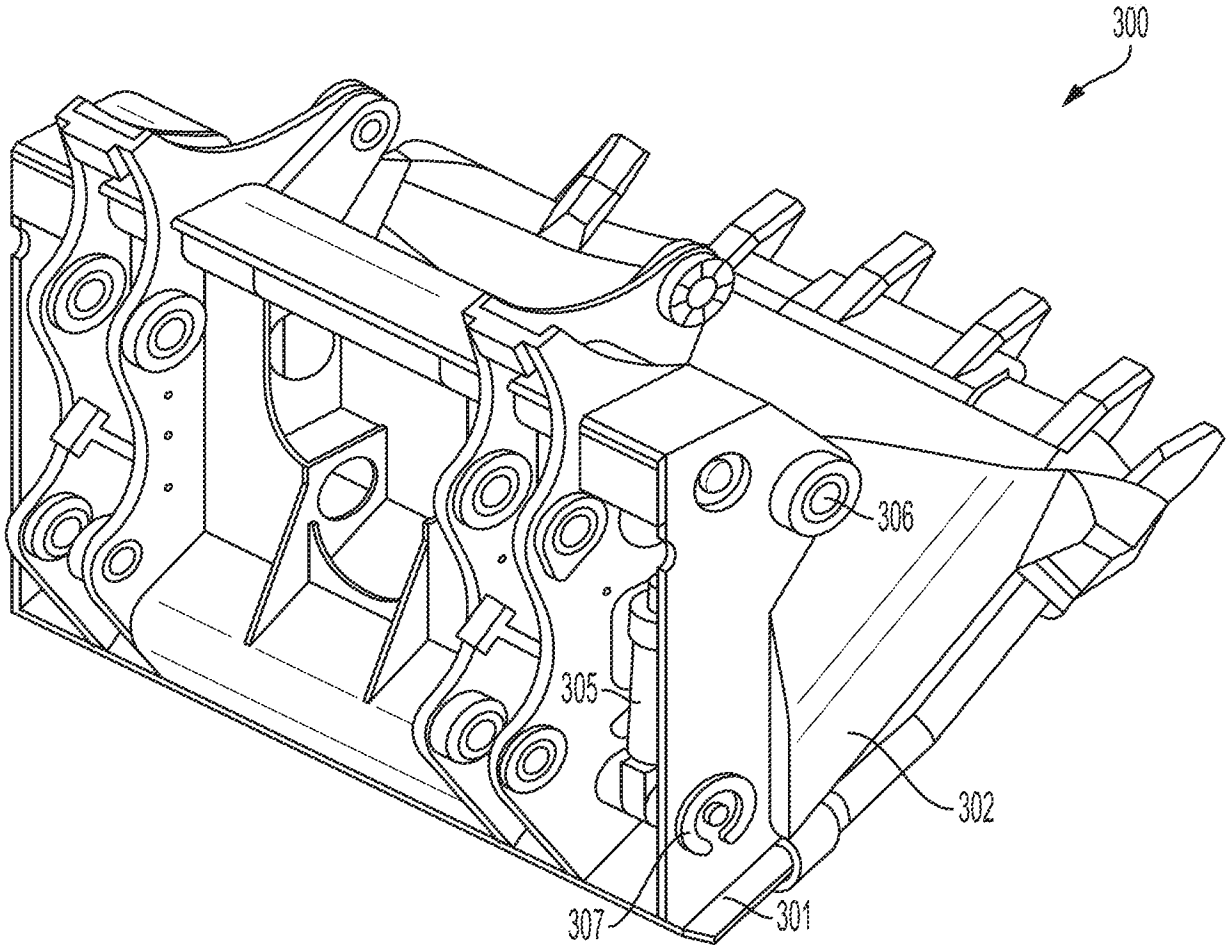
FIG. 3 illustrates a bucket and dump cylinder, according to embodiments described herein.
Figure 4:
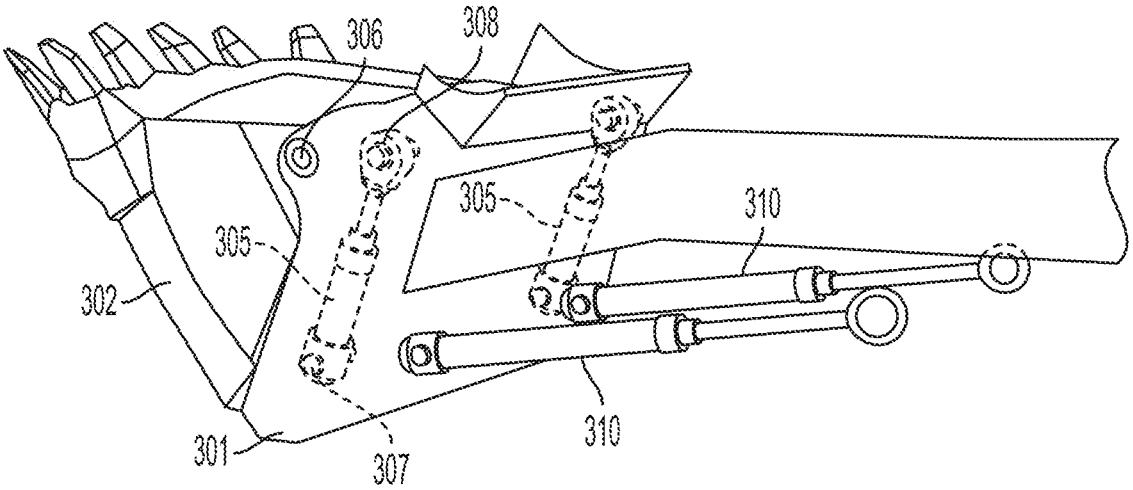
FIG. 4 illustrates dump cylinders in a fully-extended position, according to embodiments described herein.
Figure 5:
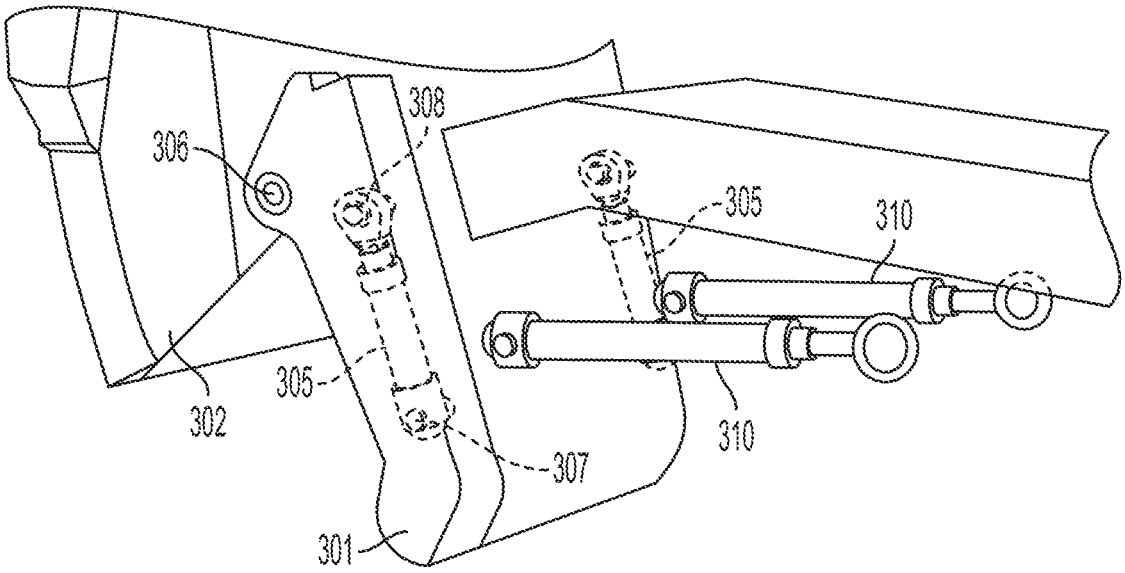
FIG. 5 illustrates dump cylinders in a fully-retracted position, according to embodiments described herein.

In some embodiments, the user interface 210 includes an input (e.g., a button, a switch, a pedal, etc.) for initiating an automated open and/or close of the bucket 125's door 130. For example, the dump cylinder position sensor 230 can be positioned within one or more dump cylinders associated with the bucket 125. FIG. 3 illustrates a bucket 300 that includes a door 301, a main body 302, and a dump cylinder 305. The bucket 300 is an example of the bucket 125 that may be attached to the shovel 100. The door 301 and main body 302 are coupled at a hinge point 306 such that the door 301 is configured to swing open to allow the contents within the main body 302 to drop out of the main body 302 and to close to keep dug materials within the main body 302. One end of the dump cylinder 305 is connected at a door connection point 307 of the door 301, and an opposite end of the dump cylinder 305 is connected to a main body connection point 308 (see FIGS. 5-6). By being extended and retracted, the dump cylinder 305 causes the door 301 to close and open with respect to the main body 302. Although only one cylinder is shown in FIG. 3, a similar dump cylinder 305 may be provided on the opposite side of the bucket 300. For example, FIG. 4 illustrates a pair of dump cylinders 305 in a fully-extended position (e.g., corresponding to the bucket door 130 being fully closed). The tilt cylinders 155, first illustrated in FIG. 1, are also illustrated in FIG. 4 in an extended position. The tilt cylinders 155 each have a first end coupled to the door 301 and a second end coupled to the bucket handle 120. FIG. 5 illustrates the dump cylinders 305 in a fully-retracted position (e.g., corresponding to the bucket door 130 being fully open). Similarly, the tilt cylinders 155 are also in a retracted position.

Figure 6:
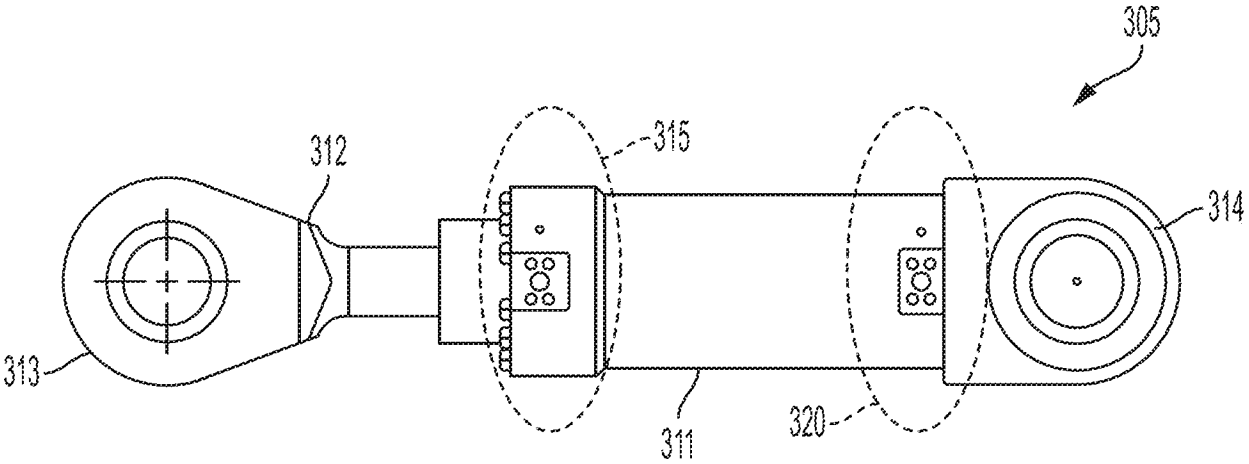
FIG. 6 illustrates a dump cylinder, according to embodiments described herein.

The dump cylinder 305 is illustrated in more detail in FIG. 6. The dump cylinder 305 includes a cylinder portion 311 and a piston 312. The piston 312 includes a first connector 313 configured to be coupled to the main body connection point 308 on the main body 302. The cylinder portion 311 includes a second connector 314 configured to be coupled to the door connection point 307. FIG. 6 also illustrates areas of impact 315, 320 when the dump cylinder is full-extended or fully-retracted.

Figure 7:
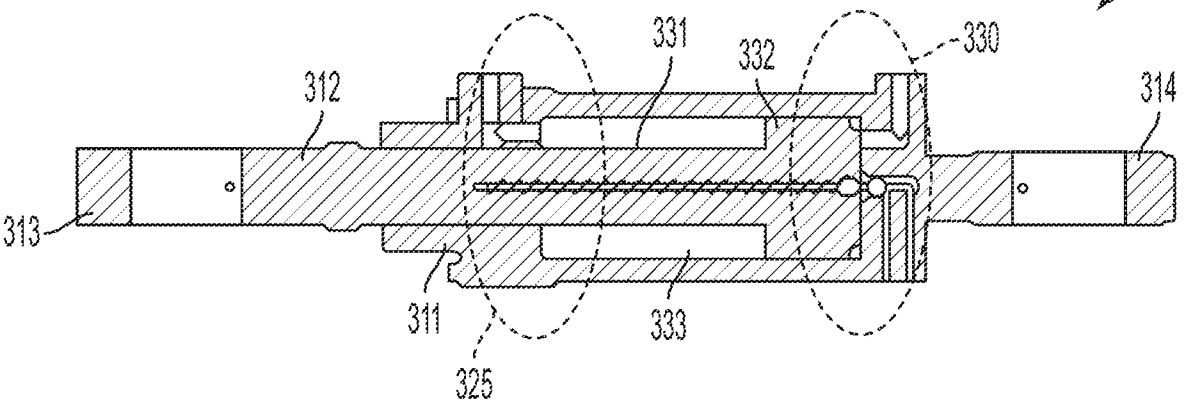
FIG. 7 illustrates a cross-section of the dump cylinder of FIG. 6.

FIG. 7 illustrates the same areas of impact, labeled 325, 330, respectively, but with the dump cylinder 305 shown in cross-section. As shown in FIG. 7, the piston 312 further includes a shaft 331 and a piston head 332, and is configured to translate linearly within a cylindrical chamber 333 of the cylinder portion 311. FIG. 7 illustrates the dump cylinder 305 in a fully retracted state, with the piston 312 illustrated at a far-right position within the cylindrical chamber 313. In a fully extended state (e.g., as shown in FIG. 5), the piston 312 would be at a far-left position within the cylindrical chamber 313 in the view of FIG. 7.

Figure 8:
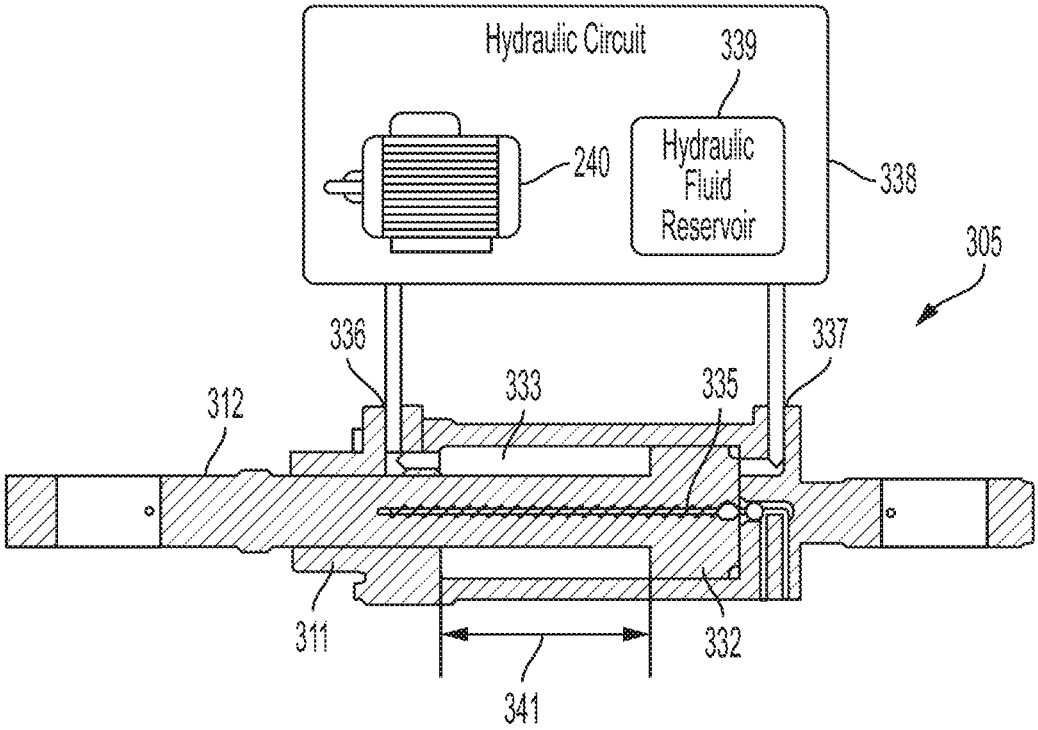
FIG. 8 illustrates a dump cylinder including a sensor, according to embodiments described herein.
Figure 9:
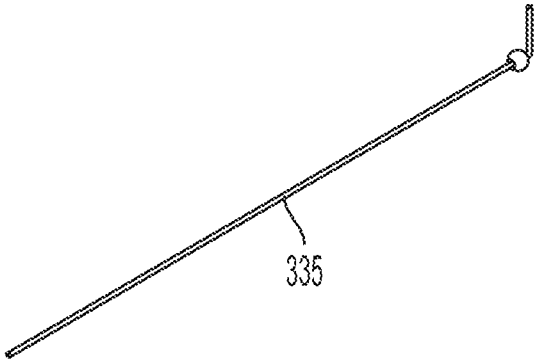
FIG. 9 illustrates the sensor of FIG. 8.

With reference to FIGS. 8 and 9, the dump cylinder 305 includes a sensor 335 (e.g., a linear position sensor). The sensor 335 is an example of one of the dump cylinder position sensors 230 coupled to the controller 205 (see FIG. 2). The sensor 335 provides an output signal to the controller 205 related to the linear position of the piston of the dump cylinder 305. For example, the output signal may be a voltage signal that is proportional to the amount of linear extension of the sensor 335 caused by linear movement of the piston 312 within the cylindrical chamber 333. For example, the sensor 335 may have a first end connected to the cylinder portion 311, and a second end connected to the piston 312, such that relative movement between the piston 312 and the cylinder portion 311 causes extension (or retraction, as the case may be) of the sensor 335. Based on the output signal from the sensor 335, the controller 205 is configured to determine, for example, whether the bucket door 130 is fully-opened, fully-closed, or somewhere in between. Like FIG., FIG. 8 illustrates the piston 312 as fully retracted within the cylinder portion 111. The piston 312 may extend out of the cylinder portion 111 by traveling linearly to the left until the piston head 332 reaches the end of the chamber 333, as illustrated by a travel path 341. In other embodiments, one or more of a different number, arrangement, and orientation of dump cylinders are provided on the bucket 300.

FIG. 8 also illustrates hydraulic circuit ports 336 and 337 of the dump cylinder 305 connected to a hydraulic circuit 338. The hydraulic circuit 338 includes the dump actuator 240, a hydraulic fluid reservoir 339, and one or more controllable valves (not shown) controlled, for example, by the controller 205. In an example operation, as hydraulic fluid is pumped into port 337, the piston 312 is extended out of the cylinder portion 311 (i.e., to the left, in FIG. 8). As the piston 312 is extended, the piston head 332 pushes hydraulic fluid within the chamber 333 out of the port 336. Conversely, as hydraulic fluid is pumped into port 336, the piston 312 is retracted into the cylinder portion 311 (i.e., to the right, in FIG. 8), and the piston head 332 pushes hydraulic fluid out of the chamber 333 through the port 337. In some embodiments, the dump actuator 240 operates as the hydraulic pump controlling the flow of hydraulic fluid in and out of the ports 336, 337. In some embodiments, other hydraulic circuit arrangements are used to control the extension and retraction of the dump cylinder(s) 305.

When an operator of the shovel 100 activates automatic control of the dumping operation (e.g., by pressing an activation button) when the bucket door 130 is fully closed, the controller 205 controls, or causes the dump control drive 235 to control, the dump actuator 240 to drive the door cylinder(s) 305 to a full-open position at an initial speed (e.g., such as a maximum speed). In some embodiments, the dump actuator 240 is a hydraulic actuator. As the piston 312 of the dump cylinder 305 approaches the full-open position, the speed of the piston 312 can be ramped down by the controller 205 to reduce the shock loads experienced by the dump cylinder 305 when the full-open position is reached. Similarly, when the operator of the shovel 100 activates automatic control of the dumping operation (e.g., by pressing the activation button) when the bucket door 130 is fully open, the controller 205 controls, or causes the dump control drive 235 to control, the dump actuator 240 to drive the door cylinder(s) 305 to a full-close position at an initial speed (e.g., such as a maximum speed). As the piston 312 of the dump cylinder 305 approaches the full-closed position, the speed of the piston 312 can be ramped down by the controller 205 to reduce the shock loads experienced by the dump cylinder 305 when the full-close position is reached. In some embodiments, the operator can override automated dump control at any time by deactivating automatic control of the dumping operation (e.g., by pressing the activation button a second time) or by operating another input in the user interface 210 (e.g., a foot pedal, a thumbwheel, etc.). In some embodiments, automated dump control is implemented with conventional dump control (e.g., foot pedal dump control). In such embodiments, the operator is able to activate automated dump control but, when the operator wants to regulate the flow of material from the bucket 125, conventional, manual dump control can be used.

Figure 10:
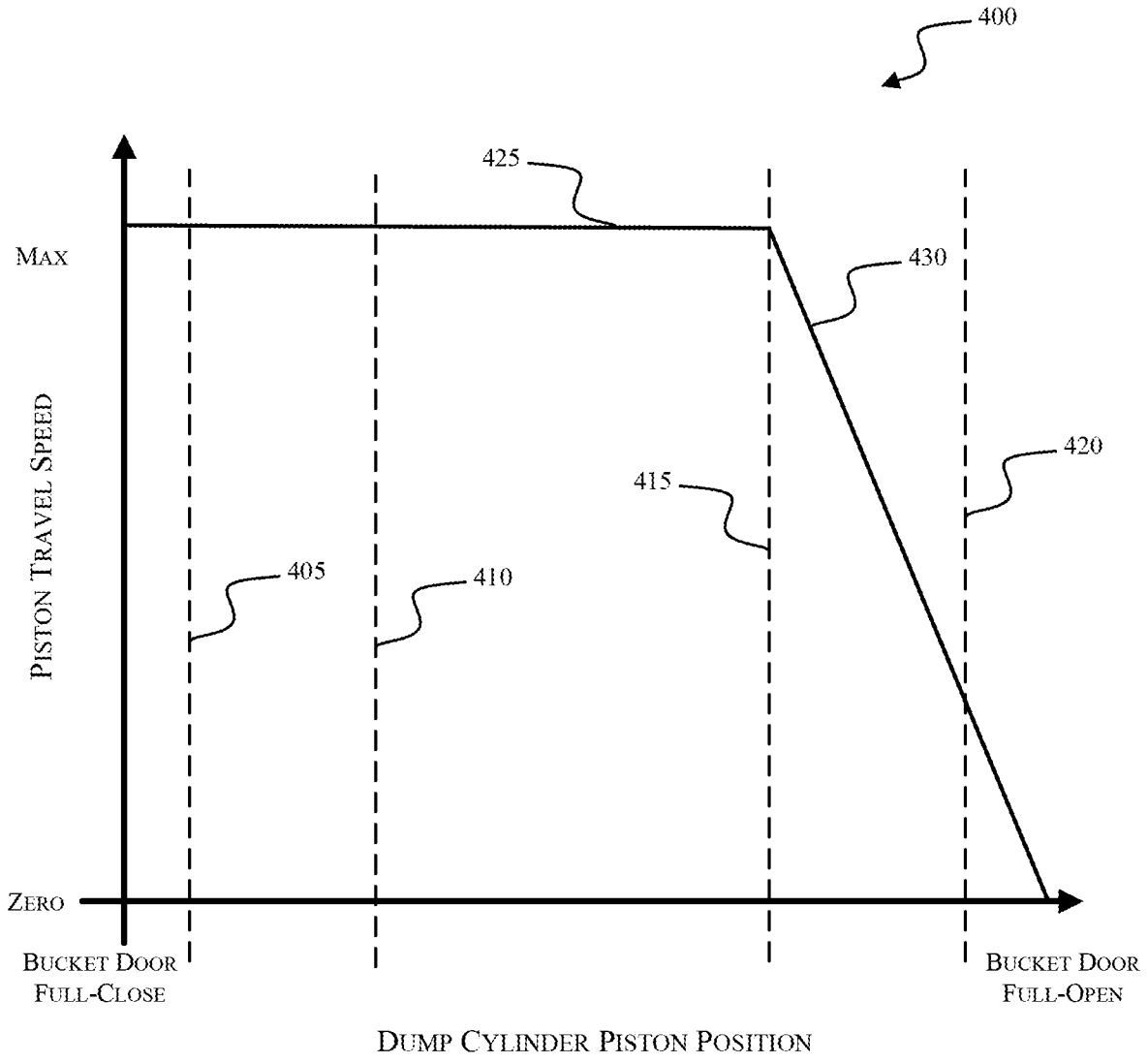
FIG. 10 illustrates a dump cylinder speed control graph for a bucket door going from a full-close position to a full-open position, according to embodiments described herein.

FIG. 10 illustrates a dump cylinder speed control graph 400 for the bucket door 130 going from a full-close position to a full-open position. The graph 400 includes a full-close target position 405, a first maximum speed transition point 410, a second maximum speed transition point 415, a full-open target position 420, a maximum speed portion 425, and a ramp-down speed portion 430. The second maximum speed transition point 415 corresponds to the point at which the controller 205 begins to slow down the piston of the dump cylinder 305 as the full-open target position 420 is approached. Accordingly, the second maximum speed transition point 415 is nearer to the full-open target position 420 than the full-close target position 405. At the second maximum speed transition point 415, the speed of the piston in the dump cylinder 305 transitions from the maximum speed portion 425 to the ramp-down speed portion 430. In some embodiments, the full-open target position 420 is a point at which the controller 205 determines that the bucket door 130 is in a fully-open position. FIG. 10 illustrates a linear ramp-down portion 430. In some embodiments, a logarithmic, quadratic, or another function can be used to control speed ramp down of the piston (e.g., a non-linear ramp-down portion). Although the graph 400 in FIG. 10 shows that the speed of the piston in the dump cylinder 305 is operated at maximum speed during the maximum speed portion 425, in some embodiments, the speed of the piston 312 in the maximum speed portion 425 (the initial speed) is less than a maximum operation speed of the dump cylinder (e.g., 75%, 80%, or 90% of maximum speed). Regardless, when the piston reaches the second maximum speed transition point 415, the speed of the piston is reduced from the initial speed.

Figure 11:
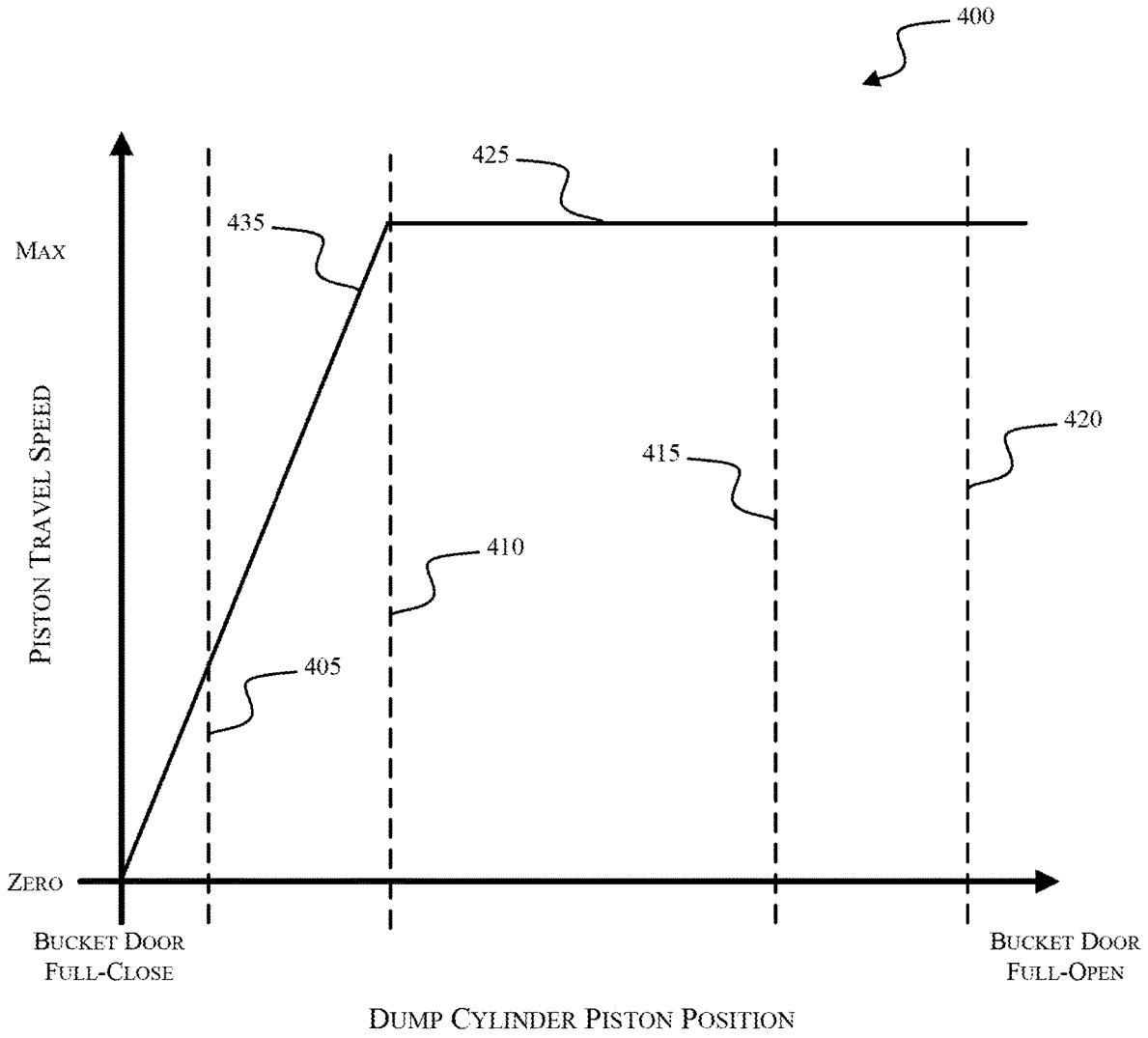
FIG. 11 illustrates a dump cylinder speed control graph for a bucket door going from a full-open position to a full-close position, according to embodiments described herein.

FIG. 11 illustrates the dump cylinder speed control graph 400 for the bucket door 130 going from the full-open position to the full-close position. The graph 400 includes the full-close target position 405, the first maximum speed transition point 410, the second maximum speed transition point 415, the full-open target position 420, the maximum speed portion 425, and a ramp-down speed portion 435. The first maximum speed transition point 410 corresponds to the point at which the controller 205 begins to slow down the piston of the dump cylinder 305 as the full-close target position 405 is approached. Accordingly, the first maximum speed transition point 410 is nearer to the full-close target position 405 than the full-open target position 420. At the first maximum speed transition point 410, the speed of the piston in the dump cylinder 305 transitions from the maximum speed portion 425 to the ramp-down speed portion 435. In some embodiments, the full-close target position 405 is a point at which the controller 205 determines that the bucket door 130 is in a fully-closed position. FIG. 11 illustrates a linear ramp-down portion 435. In some embodiments, a logarithmic, quadratic, or another function can be used to control speed ramp down of the piston (e.g., a non-linear ramp-down portion). Although the graph 400 in FIG. 11 shows that the speed of the piston in the dump cylinder 305 is operated at maximum speed during the maximum speed portion 425, in some embodiments, the speed of the piston 425 in the maximum speed portion 425 (the initial speed) is less than a maximum operation speed of the dump cylinder (e.g., 75%, 80%, or 90% of maximum speed). Regardless, when the piston reaches the first maximum speed transition point 410, the speed of the piston is reduced from the initial speed.

In some embodiments, calibration of the dump cylinder position sensor 230 can be automated. For example, the user interface 210 can be configured to receive an input (e.g., a button press) related to the start of a calibration mode for the dump cylinder position sensor 230. After entering the calibration mode, the user interface 210 can be configured to receive an input (e.g., an auto-dump button press) related to the start of a calibration process. In some embodiments, the calibration process ends when auto-dump is not active. During the calibration process, the controller 205 slowly applies a bucket close reference to the dump control drive 235 (in other words, sends a control signal to control the door 301 to slowly close). When the controller 205 determines that the dump cylinder 305 has stopped moving (e.g., using the dump cylinder position sensor 230), the controller 205 stores a fully-closed value for the output signal from the dump cylinder position sensor 230 in the memory 265. The controller 205 can then slowly apply a bucket open reference to the dump control drive 235 (in other words, sends a control signal to control the door 301 to slowly open). When the controller 205 determines that the dump cylinder 305 has stopped moving (e.g., using the dump cylinder position sensor 230), the controller 205 stores a fully-opened value for the output signal from the dump cylinder position sensor 230 in the memory 265. In some embodiments, the full-close target position 405, the first maximum speed transition point 410, the second maximum speed transition point 415, the full-open target position 420, the maximum speed portion 425, the ramp-down speed portion 430, and the ramp-down speed portion 435 have predefined values stored in the memory 265 (e.g., with respect to a full-opened position and a fully-closed position). After the calibration process is completed, controller 205 applies the full-close target position 405, the first maximum speed transition point 410, the second maximum speed transition point 415, the full-open target position 420, the maximum speed portion 425, the ramp-down speed portion 430, and the ramp-down speed portion 435 values to the operating envelope of the dump cylinders 305 (i.e., based on the calibrated full-opened position and calibrated fully-closed position). For example, these values may be used in the processes 500 and 700 described below. Accordingly, through the calibration process, among other things, the controller is configured to learn the full-open target position 420, the full-close target position 405, and the speed transition points 410 and 415 of the dump cylinder.

Figure 12:
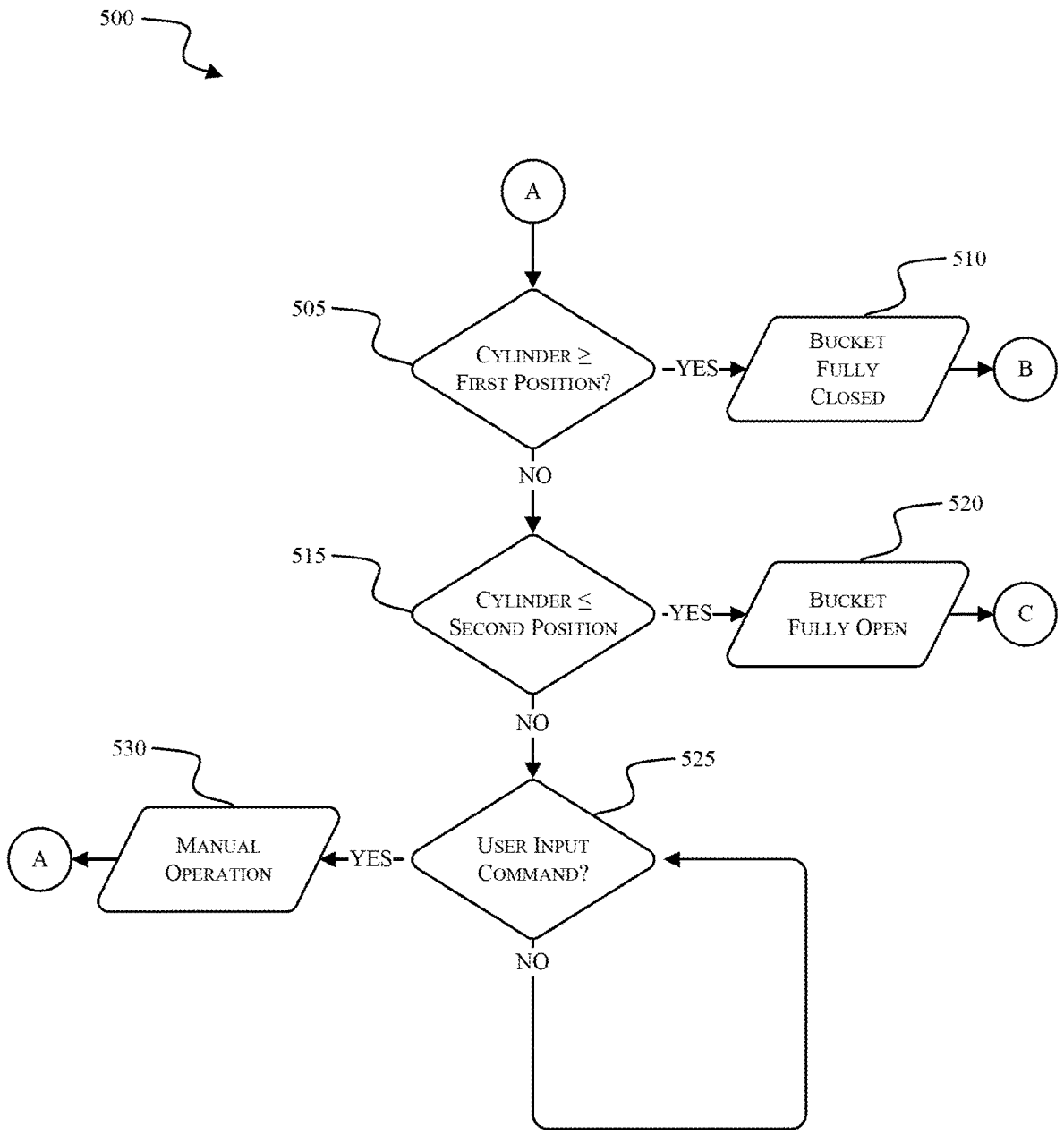
FIGS. 12, 13, and 14 are a process for automatically controlling a dumping operation of the industrial machine of FIG. 1, according to embodiments described herein.
Figure 13:
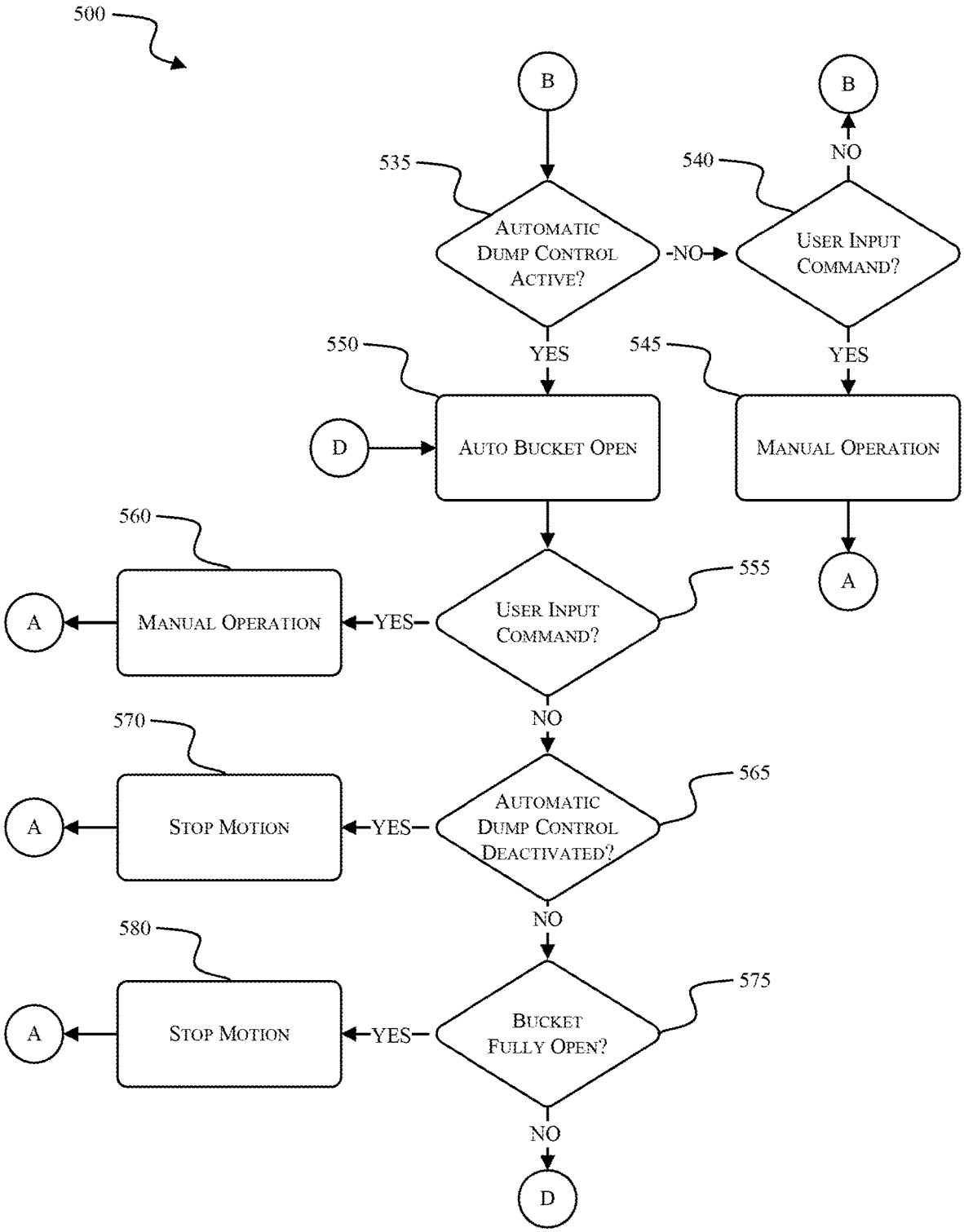
Figure 14:
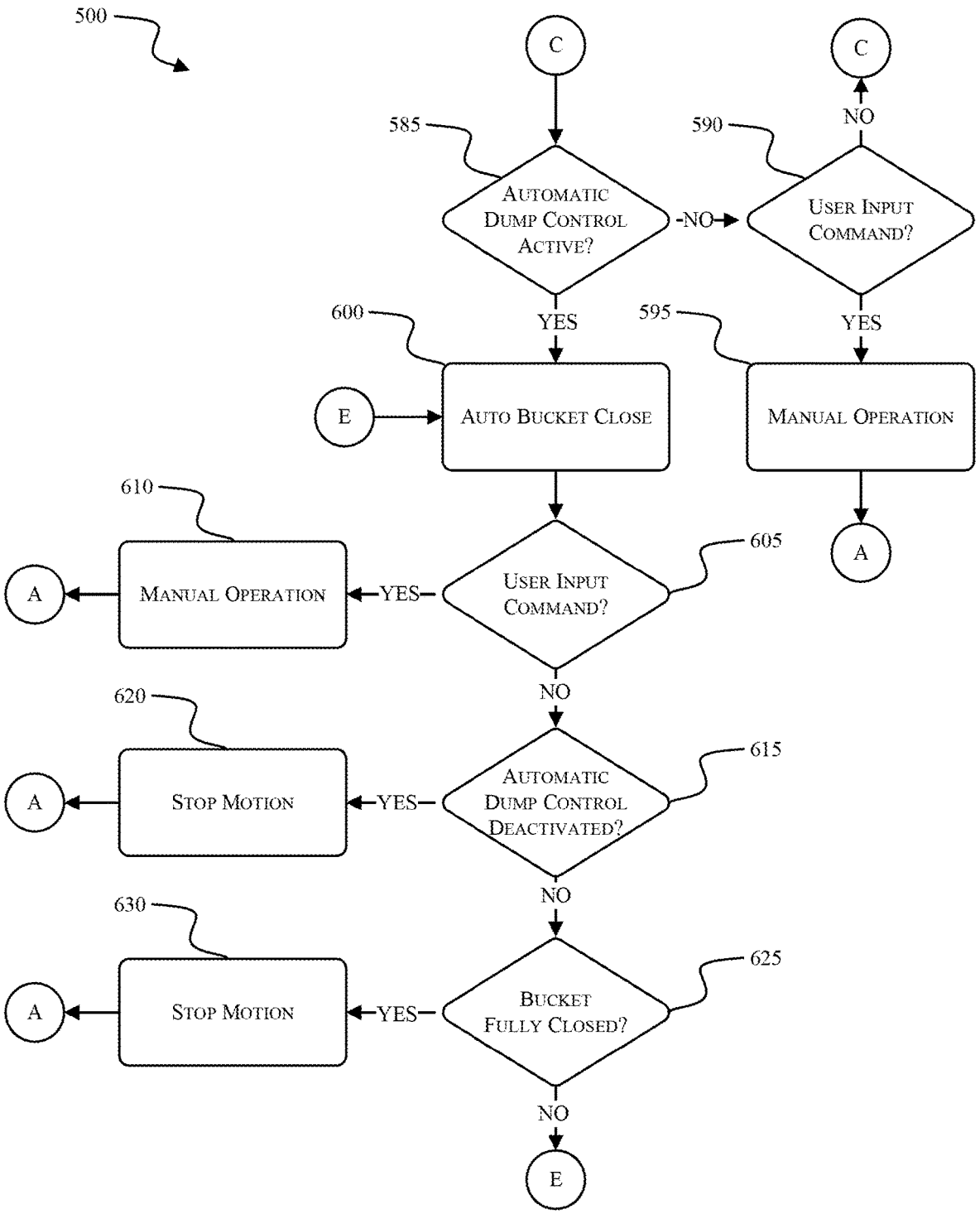

FIGS. 12-14 illustrate a process 500 for automatically controlling a dump operation of the bucket 125 for the shovel 100. At STEP 505, the controller 205 determines whether the position of the bucket 125 is fully-closed. The controller 205 determines that the position of the bucket 125 is fully-closed when the extension of the dump cylinder is greater than or equal to the extension of the dump cylinder at the full-close target position 405. When the controller 205 determines that the position of the dump cylinder is greater than or equal to the full-close target position 405, the controller 205 determines that the bucket 125 is fully closed (STEP 510), and the process 500 proceeds to control section B shown in and described with respect to FIG. 13. When, at STEP 505, the position of the dump cylinder is less than the full-close target position 405, the controller 205 determines whether the position of the bucket is fully-opened (STEP 515). The controller 205 determines that the position of the bucket 125 is fully-opened when the extension of the dump cylinder is less than or equal to the extension of the dump cylinder at the full-open target position 420. When the controller 205 determines that the position of the dump cylinder is less than or equal to the full-open target position 420, the controller 205 determines that the bucket 125 is fully open (STEP 520), and the process 500 proceeds to control section C shown in and described with respect to FIG. 14. When, at STEP 515, the position of the dump cylinder is greater than the full-open target position 420, the controller 205 determines whether a user input command (e.g., caused by an operator activating a foot pedal, activating a thumb wheel, etc.) has been received by the controller 205 (STEP 525). When the controller 205 has not received a user input command, the process 500 waits at STEP 525 to receive a user input command. After a user input command is received at STEP 525, manual operator control is initiated (STEP 530) and the process 500 returns to STEP 505. For example, in STEP 530, as described above, user input may be received by the controller 205 via the user interface module 210. In response to this user input, the controller 205 is configured to control the position of the bucket 125, the position of the boom 135, the position of the bucket handle 120, etc. For example, the user input may include one or more of the following commands: hoist up, hoist down, crowd extend, crowd retract, swing clockwise, swing counterclockwise, bucket door open, left track forward, left track reverse, right track forward, and right track reverse.

With reference to FIG. 13 and control section B of the process 500, the controller 205 determines whether a signal to activate automatic dump control has been received (e.g., operator presses an activation button of the user interface 210) (STEP 535). When the controller 205 does not receive the signal to activate automatic dump control, the controller 205 determines whether an operator has provided a user input command (e.g., activating a foot pedal, activating a thumb wheel, etc. of the user interface 210) (STEP 540). When the controller 205 does not receive a user input command, the process 500 returns to STEP 535 to determine whether the signal to activate automatic dump control has been received. When, at STEP 540, a user input command is received, manual operator control is initiated (STEP 545), and the process 500 returns to control section A shown in and described with respect to FIG. 12. Manual operator control in STEP 545 is similar to manual operator control in STEP 530, described above.

If, at STEP 535, the controller 205 receives the signal to activate automatic dump control, the controller 205 initiates the automatic dump control to open the bucket 125 (STEP 550). Automatic dump control to open the bucket 125 corresponds, for example, to the dump cylinder speed control graph 400 shown in and described with respect to FIG. 10. In other words, to implement the automatic dump control to open the door 301, at least in some embodiments, the controller 205 controls the dump cylinder 305 according to the dump cylinder speed control graph 400 show in and described with respect to FIG. 10.

If, during the automatic opening of the bucket 125, the controller 205 receives a user input command (e.g., activating a foot pedal, activating a thumb wheel, etc.) (STEP 555), the controller 205 ends the automatic opening of the bucket 125 and initiates manual operator control (STEP 560). Manual operator control in STEP 560 is similar to manual operator control in STEP 530. The process 500 then returns to control section A shown in and described with respect to FIG. 12. When no user input command is received at STEP 555, the controller 205 determines whether a signal to deactivate automatic dump control has been received (e.g., operator presses an activation button a second time) (STEP 565). When, at STEP 565, a signal to deactivate automatic dump control is received, the motion of the dump cylinders 305 is stopped (STEP 570), and the process 500 returns to control section A shown in and described with respect to FIG. 12. When no signal to deactivate automatic dump control is received at STEP 565, the controller 205 determines whether the bucket 125 is fully open (STEP 575). When the controller 205 determines that the bucket 125 is fully open, the motion of the dump cylinders 305 is stopped (STEP 580), and the process 500 returns to control section A shown in and described with respect to FIG. 12. As described above with respect to STEPS 515 and 520 of FIG. 12, the controller 205 is configured to determine that the bucket 125 is fully open in response to (i) receiving an output signal from the dump cylinder position sensor 230, and (ii) determining that the dump cylinder piston position indicated by the output signal is less than the full-open target position 420. When, at STEP 575, the bucket 125 is not fully open, the process 500 returns to STEP 550 where the controller 205 continues to perform automatic dump control.

With reference to FIG. 14 and control section C of the process 500, the controller 205 determines whether a signal to activate automatic dump control has been received (e.g., operator presses an activation button of the user interface 210) (STEP 585). When the controller 205 does not receive the signal to activate automatic dump control, the controller 205 determines whether an operator has provided a user input command (e.g., activating a foot pedal, activating a thumb wheel, etc. of the user interface 210) (STEP 590). When the controller 205 does not receive a user input command, the process 500 returns to STEP 585 to determine whether the signal to activate automatic dump control has been received. When, at STEP 590, a user input command is received, manual operator control is initiated (STEP 595), and the process 500 returns to control section A shown in and described with respect to FIG. 12. Manual operator control in STEP 595 is similar to manual operator control in STEP 530, described above.

If, at STEP 585, the controller 205 receives the signal to activate automatic dump control, the controller 205 initiates the automatic dump control to close the bucket 125 (STEP 600). Automatic dump control to close the bucket 125 corresponds, for example, to the dump cylinder speed control graph 400 shown in and described with respect to FIG. 11. In other words, to implement the automatic dump control to close the door 301, at least in some embodiments, the controller 205 controls the dump cylinder 305 according to the dump cylinder speed control graph 400 show in and described with respect to FIG. 11.

If, during the automatic closing of the bucket 125, the controller 205 receives a user input command (e.g., activating a foot pedal, activating a thumb wheel, etc.) (STEP 605), the controller 205 ends the automatic closing of the bucket 125 and initiates manual operator control (STEP 610). Manual operator control in STEP 310 is similar to manual operator control in STEP 530. The process 500 then returns to control section A shown in and described with respect to FIG. 12. When no user input command is received at STEP 605, the controller 205 determines whether a signal to deactivate automatic dump control has been received (e.g., operator presses an activation button a second time) (STEP 615). When, at STEP 615, a signal to deactivate automatic dump control is received, the motion of the dump cylinders 305 is stopped (STEP 620), and the process 500 returns to control section A shown in and described with respect to FIG. 12. When no signal to deactivate automatic dump control is received at STEP 615, the controller 205 determines whether the bucket 125 is fully closed (STEP 625). When the controller 205 determines that the bucket 125 is fully closed, the motion of the dump cylinders 305 is stopped (STEP 630), and the process 500 returns to control section A shown in and described with respect to FIG. 12. As described above with respect to STEPS 505 and 510 of FIG. 12, the controller 205 is configured to determine that the bucket 125 is fully closed in response to (i) receiving an output signal from the dump cylinder position sensor 230, and (ii) determining that the dump cylinder piston position indicated by the output signal is greater than the full-close target position 405. When, at STEP 625, the bucket 125 is not fully closed, the process 500 returns to STEP 600 where the controller 205 continues to perform automatic dump control.

Figure 15:
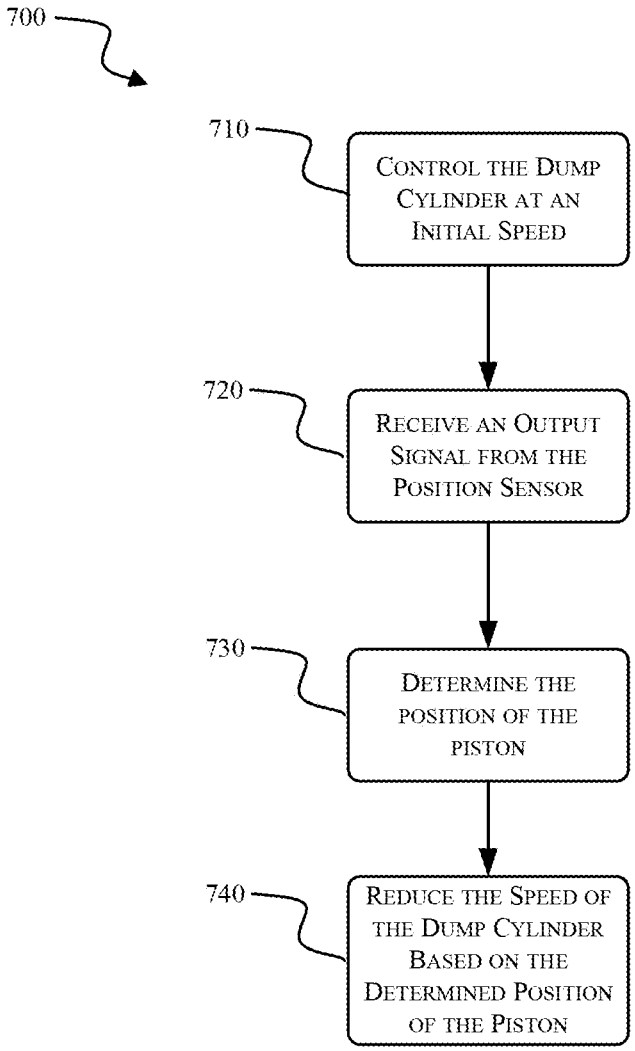
FIG. 15 is a process for automatically controlling a dumping operation of the industrial machine of FIG. 1, according to embodiments described herein.

FIG. 15 illustrates a process 700 for automatically controlling a dump operation of the bucket 125 for the shovel 100. In STEP 710, an electronic controller, such as the controller 205, controls the dump cylinder 305 at an initial speed to move the door 301 from a first position towards a second position. For example, in response to detecting a request to automatically open the door 301 (see, e.g., STEP 550) or automatically close the door 301 (see, e.g., STEP 600), the controller 205 controls the dump actuator 240 to move the piston 312 of the dump cylinder 305 at an initial speed. This control of the dump cylinder 305 at an initial speed is illustrated, for example, in the maximum speed portions 425 of the graph 400 in FIGS. 10 and 11. The initial speed may be the maximum speed or another initial speed. The first position is, for example, the full-close position of the door 301 (e.g., at or below the full-close target position 405 in FIGS. 10 and 11) or may be the full-open position of the door 301 (e.g., at or above the full-open target position 420 in FIGS. 10 and 11).

In STEP 720, the controller 205 receives an output signal from the position sensor 230. For example, as previously described, the position sensor 230 (an example of which is illustrated in FIG. 9 as the position sensor 335) may output a voltage signal having a voltage proportional to the position of the piston 312 within the dump cylinder 305. The position of the piston 312 within the dump cylinder 305 may correspond to the extension amount of the piston 312 out of the cylinder portion 311.

In STEP 730, the controller 205 determines the position of the piston 312 based on the output signal from the position sensor 230. For example, the controller 205 may determine a voltage level of the output signal from the position sensor 230, and translate the voltage signal to a position value (e.g., using a look up table or a translation equation). The position value may be, for example, a numerical value indicative of the extension amount of the piston 312 out of the cylinder portion 311. With reference to the graph 400 of FIGS. 10 and 11, the numerical value indicative of the extension amount of the piston 312 may be represented along the x-axis of the graph 400. Although along the x-axis of the graphs of FIGS. 10 and 11, the fully-closed position is shown as a lesser value than the fully-opened position, in some embodiments, the reference system is reversed such that the fully-closed position is a greater value than the fully-opened position.

In STEP 740, as the dump cylinder 305 moves the door 301 from the first position towards the second position, the controller 205 reduces the speed of the dump cylinder 305 from the initial speed based on the determined position of the piston. For example, as the dump cylinder 305 is controlled to move the door 301 from the first position (e.g., fully-closed position) towards the second position (e.g., fully-opened position), the controller 205 may continuously receive a signal from the position sensor 230 and determine the position of the piston 312. The controller 205 may continuously compare the determined position to the speed transition point 410 (when closing) or the speed transition point 415 (when opening). Then, when the controller 205 determines, based on the output signal from the position sensor 230, that the piston 312 has reached the corresponding speed transition point 410 or 415, the controller reduces the speed of the dump cylinder from the initial speed. As noted, the controller 205 may reduce the speed of the dump cylinder 305 according to a function selected from the group of a linear ramp-down function (see FIGS. 10 and 11), a logarithmic ramp-down function, and quadratic ramp-down function.

In some embodiments, the controller 205 may further continue to monitor the signal from the position sensor 230 and determine, based on a further output signal from the position sensor, when the piston 312 reaches the second position (e.g., a full-open target position 420 or full-close target position 405). In response, the controller 205 may stop the dump cylinder 305 based on determining that the piston 312 reaches the second position. For example, the controller 205 may stop sending control signals to the dump actuator 240 (e.g., via the dump control drive 235) to stop the driving of hydraulic fluid within the dump cylinder 305.

In some embodiments, as described above, the controller 205 may further calibrate the position sensor 230 to thereby learn the first position, the second position, and the speed transition point of the dump cylinder.

In some embodiments, after the door has reached the second position and stopped, the controller 205 may control the dump cylinder 305 to return to the first position using a similar process as the process 700. For example, when the second position is the full-open target position 420 and the first position is the full-close target position 405 (i.e., the process steps 710-740 are used to open the door 301), after the door 301 has fully opened, the controller 205 may receive a signal for an automatic close of the door 301 (see, e.g., STEP 600 of FIG. 14). In response, the controller 205 controls the dump cylinder 305 at an initial return speed to move the door 301 from the second position towards the first position, similar to the STEP 710. The controller 205 then receives a further output signal from the position sensor 230 and determines the position of the piston 312 based on the further output signal, similar to STEPS 720 and 730. Then, similar to STEP 740, as the dump cylinder 305 moves the door 301 from the second position towards the first position, the controller 205 reduces the speed of the dump cylinder 305 from the initial return speed based on the position of the piston 312 determined based on the further output signal. The initial return speed may be the same speed as the initial speed (albeit in the opposite direction), or may be another speed. The initial return speed may be a maximum speed of the dump cylinder 305, or may be another speed. The controller may determine to reduce the speed of the dump cylinder 305 based on determining, from the further output signal, that the piston 312 has reached the speed transition point 410 (when closing the door 301) or 415 (when opening the door 301).

As described with respect to FIGS. 13 and 14, during the course of an automatic close or automatic open operation, the controller 205 may receive a user input command indicating manual operator control (STEP 555 and STEP 605) or may receive a signal to deactivate automatic dump control (STEP 565 and STEP 615). Similarly, in some embodiments, during the process 700 of FIG. 15, the controller 205 may receive a user input command indicating manual operator control or may receive a signal to deactivate automatic dump control. In response to receiving a user input command indicating manual operator control or a signal to deactivate automatic dump control, the controller 205 may exit the process 700 and initiate manual operator control or stop movement of the dump cylinder 305.

Although the processes 500 and 700 are described in a series of serially executed steps and as being executed in a particular order, in some embodiments, one or more of the steps are executed in parallel, or at least partially in parallel, or in a different order than described.

Thus, embodiments described herein provide, among other things, an industrial machine that includes automated dump control.

What is claimed is:

1. An industrial machine comprising:

a bucket having a main body and a door, the industrial machine configured to maneuver the bucket to dig material;

a dump cylinder having a piston and configured to open and close the door;

a position sensor configured to sense a position of the piston within the dump cylinder;

an electronic controller including a processor and a memory, the electronic controller configured to:

control the dump cylinder at an initial speed from a first position towards a second position to move the door, receive an output signal from the position sensor, determine the position of the piston based on the output signal, and as the dump cylinder moves from the first position towards the second position, reduce a speed of the dump cylinder from the initial speed based on the determined position of the piston.

2. The industrial machine of claim 1, wherein the electronic controller is further configured to:

determine, based on a further output signal from the position sensor, when the piston reaches the second position, and stop the dump cylinder based on determining that the piston reaches the second position.

3. The industrial machine of claim 1, wherein the first position is selected from a group of a full-open target position in which the door is open and materials within the bucket are dumped and a full-close target position in which the door is closed and materials within the bucket are retained, and the second position is the other of the full-open target position and the full-close target position.

4. The industrial machine of claim 1, wherein, to reduce the speed of the dump cylinder from the initial speed based on the output signal, the electronic controller is configured to reduce the speed of the dump cylinder according to a function selected from a group of a linear ramp-down function, a logarithmic ramp-down function, and quadratic ramp-down function.

5. The industrial machine of claim 1, wherein the second position is an end of travel position, and the piston further includes a speed transition point located between the first position and the second position, the speed transition point being nearer to the second position than the first position, and wherein, to reduce the speed of the dump cylinder from the initial speed based on the output signal, the electronic controller is configured to:

determine, based on the output signal, that the piston has reached the speed transition point, and, in response, reduce the speed of the dump cylinder from the initial speed.

6. The industrial machine of claim 5, wherein the electronic controller is further configured to:

calibrate the position sensor to thereby learn the first position, the second position, and the speed transition point of the dump cylinder.

7. The industrial machine of claim 1, wherein the electronic controller is further configured to:

control the dump cylinder at an initial return speed from the second position towards the first position to move the door, receive a further output signal from the position sensor, determine the position of the piston based on the further output signal, and as the dump cylinder moves from the second position towards the first position, reduce the speed of the dump cylinder from the initial return speed based on the position of the piston determined based on the further output signal.

8. The industrial machine of claim 1, wherein at least one selected from a group of the initial speed and the initial return speed is a maximum speed of the dump cylinder.

9. The industrial machine of claim 1, the electronic controller further configured to:

receive a signal to activate an automatic dump control from a user interface, wherein the electronic controller is configured to control the dump cylinder at the initial speed to move from the first position towards the second position in response to receiving the signal to activate the automatic dump control.

10. A method of controlling a bucket of an industrial machine that is configured to maneuver the bucket to dig material, the bucket having a main body and a door, the method comprising:

controlling, by an electronic controller, a dump cylinder at an initial speed from a first position towards a second position to move the door of the bucket, the dump cylinder having a piston and configured to open and close the door;

receiving, by the electronic controller, an output signal from a position sensor that is configured to sense a position of the piston within the dump cylinder;

determining, by the electronic controller, the position of the piston based on the output signal; and as the dump cylinder moves from the first position towards the second position, reducing, by the electronic controller, a speed of the dump cylinder from the initial speed based on the determined position of the piston.

11. The method of claim 10, further comprising:

determining, by the electronic controller, when the piston reaches the second position based on a further output signal from the position sensor; and stopping the dump cylinder based on determining that the piston reaches the second position.

12. The method of claim 10, wherein the first position is selected from a group of a full-open target position in which the door is open and materials within the bucket are dumped and a full-close target position in which the door is closed and materials within the bucket are retained, and the second position is the other of the full-open target position and the full-close target position.

13. The method of claim 10, wherein, to reduce the speed of the dump cylinder from the initial speed based on the output signal, the electronic controller reduces the speed of the dump cylinder according to a function selected from a group of a linear ramp-down function, a logarithmic ramp-down function, and quadratic ramp-down function.

14. The method of claim 10, wherein the second position is an end of travel position, and the piston further includes a speed transition point located between the first position and the second position, the speed transition point being nearer to the second position than the first position, and wherein, to reduce the speed of the dump cylinder from the initial speed based on the output signal, the electronic controller:

determines, based on the output signal, that the piston has reached the speed transition point, and, in response, reduce the speed of the dump cylinder from the initial speed.

15. The method of claim 14, further comprising:

calibrating the position sensor to thereby learn the first position, the second position, and the speed transition point of the dump cylinder.

16. The method of claim 10, further comprising:

controlling, by the electronic controller, the dump cylinder at an initial return speed from the second position towards the first position to move the door, receiving, by the electronic controller, a further output signal from the position sensor, determining, by the electronic controller, the position of the piston based on the further output signal, and as the dump cylinder moves from the second position towards the first position, reducing, by the electronic controller, the speed of the dump cylinder from the initial return speed based on the position of the piston determined based on the further output signal.

17. The method of claim 10, wherein at least one selected from a group of the initial speed and the initial return speed is a maximum speed of the dump cylinder.

18. The method of claim 10, further comprising:

receiving, by the electronic controller, a signal to activate an automatic dump control from a user interface, wherein controlling, by the electronic controller, the dump cylinder at the initial speed to move from the first position towards the second position is in response to receiving the signal to activate the automatic dump control.

19. An industrial machine comprising:

a bucket having a main body and a door, the industrial machine configured to maneuver the bucket to dig material;

a dump cylinder having a piston and configured to open and close the door;

a position sensor configured to sense a position of the piston ; and an electronic controller including a processor and a memory, the electronic controller configured to:

control the dump cylinder at an initial speed from a first position towards a second position to move the door, receive an output signal from the position sensor , determine a position of the door based on the received output signal , as the dump cylinder moves from the first position towards the second position, reduce a speed of the dump cylinder from the initial speed , control the dump cylinder at an initial return speed from the second position towards the first position to move the door, receive a further output signal from the position sensor, determine the position of the piston based on the further output signal, and as the dump cylinder moves from the second position towards the first position, reduce the speed of the dump cylinder from the initial return speed based on the position of the piston determined based on the further output signal.

20. The industrial machine of claim 19, wherein the position sensor includes a first end coupled to a cylinder portion and a second end coupled to the piston.

* * * * *